US006598521B2

(12) United States Patent
Wikstöm

(10) Patent No.: US 6,598,521 B2
(45) Date of Patent: Jul. 29, 2003

(54) SOFT NIP CALENDER EMPLOYING A CONTINUOUS ELASTIC BELT

(75) Inventor: Magnus Wikstöm, Stockholm (SE)

(73) Assignee: Metso Paper, Inc., Helsinki (FI)

( * ) Notice: Subject to any disclaimer, the term of this patent is extended or adjusted under 35 U.S.C. 154(b) by 47 days.

(21) Appl. No.: 09/852,415

(22) Filed: May 10, 2001

(65) Prior Publication Data

US 2001/0054243 A1 Dec. 27, 2001

Related U.S. Application Data

(60) Provisional application No. 60/203,589, filed on May 11, 2000.

(51) Int. Cl.[7] ..... B30B 3/00

(52) U.S. Cl. ..... 100/327; 100/155 R; 100/173

(58) Field of Search ..... 100/155 R, 168, 100/172, 173, 176, 175, 169, 327, 153; 162/361, 360.2, 360.3

(56) References Cited

U.S. PATENT DOCUMENTS 4,978,560 A * 12/1990 Stone ..... 100/331
5,836,242 A * 11/1998 Aberg ..... 100/153
6,010,443 A * 1/2000 Dahlbom et al. ..... 162/272

FOREIGN PATENT DOCUMENTS

DE 3239954 * 5/1984

* cited by examiner

*Primary Examiner*—Allen Ostrager
*Assistant Examiner*—Shelley Self
(74) *Attorney, Agent, or Firm*—Lathrop & Clark LLP

(57) ABSTRACT

A calender having a heated first roll which is opposed to and forms a nip with a soft surface counter roll system comprised of a second roll which has an outer shell. An endless polyurethane belt or blanket having an inside diameter 5 to 50 mm larger than the outside diameter of the second roll shell, is mounted about the second roll. The outer circumferential edges of the polyurethane belt are held by clamping rings to bearings which are circumferentially mounted about the second roll on the roller gables. A small quantity of oil may be placed between the surface of the second roll shell and the polyurethane belt.

8 Claims, 4 Drawing Sheets

SOFT NIP CALENDER EMPLOYING A CONTINUOUS ELASTIC BELT

CROSS REFERENCES TO RELATED APPLICATIONS

This application claims priority on U.S. Provisional Application No. 60/203,589, Filed May 11, 2000, the disclosure of which is incorporated by reference herein.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The present invention relates to improved calenders for calendering a web.

During the 1990's a new calendering technique was introduced: the extended soft nip or the LN-calender (i.e., Long Nip) where the advantages of soft calendering were further developed. Compared to conventional soft nips, the local stress concentrations in the calender nip are substantially reduced with the extended soft nip. The required smoothing of the paper surface can therefore be obtained with minor or no increase of the local variations of the surface properties.

The LN-concept has been tested in different configurations; the shoe-belt and the roll-belt, see FIGS. 1A, 1B, and 1C.

The shoe-belt configuration 10 as shown in FIG. 1A consists of a stationary hydraulically loaded concave press shoe 12 (as shown in FIG. 1C) and an endless polymer belt 14. To prevent the friction heat developed between the stationary press shoe and the mobile polymer belt from becoming too high, an intermediate layer in the form of an oil film 16, which dissipates the pressure force, is used as shown in FIG. 1C. The length and shape of the press shoe are the dominating factors determining the nip length.

The roll-belt configuration 18, shown in FIG. 1B, is the second type of extended soft calender nip used. For this configuration, a rotary steel roll 20 instead of a stationary press shoe supports the polymer belt 22. The extended nip length is determined mainly by the belt thickness and the compressive deformation behavior of the polymer belt, which is significantly more deformable than a conventional backing roll cover. A roll that stretches the belt and an alignment roll that controls the CD-position of the belt are other necessary components of this configuration. The static nip length is estimated to be about 20–35 mm with the roll-belt configuration.

For some years both configurations were promoted. However, nowadays only the shoe-belt configuration 10 is marketed. The reason for this is due to difficulties with the scaling up of the roll-belt configuration 18, for example difficulties in controlling the cross machine direction alignment of the polymer belt 22. Nevertheless, the roll-belt configuration 18 has its advantages compared to the shoe-belt configuration, and these advantages are listed below.

Due to the fact that a rotary steel roll is used, instead of a lubricated stationary press shoe to support the polymer belt, a higher maximum compressive stress can be applied. This is beneficial when aiming for higher degrees of surface deformation of the paper products.

The construction of the shoe-belt configuration is simplified (and made possibly more cost effective) by avoiding the shoe press technology.

The energy consumption is most likely lower compared to the shoe-belt configuration since the nip is obtained without a stationary support, thus the friction, which consumes power, will be lower.

SUMMARY OF THE INVENTION

The calender of this invention has a heated first roll, mounted for rotation in a calender frame, which is opposed to and forms a nip with a soft surface counter roll system. The soft surface counter roll system is comprised of a second roll which has an outer shell. The second roll is mounted for rotation to the calender frame. An endless polyurethane belt or blanket having an inside diameter approximately 10 to 20 mm larger than the outside diameter of the second roll shell is mounted about the second roll. The outer circumferential edges of the polyurethane belt are held by clamping rings to bearings which are circumferentially mounted about the second roll on the roll gables. A small quantity of oil may be placed between the surface of the second roller shell and the polyurethane belt.

It is an object of the present invention to provide a soft nip calender of simpler design.

It is a further object of the present invention to provide a soft nip calender which provides greater maximum compressive forces.

It is another object of the present invention to provide a soft nip calender which is more energy-efficient.

Further objects, features and advantages of the invention will be apparent from the following detailed description when taken in conjunction with the accompanying drawings.

DESCRIPTION OF THE PREFERRED EMBODIMENTS

Figure 1A:
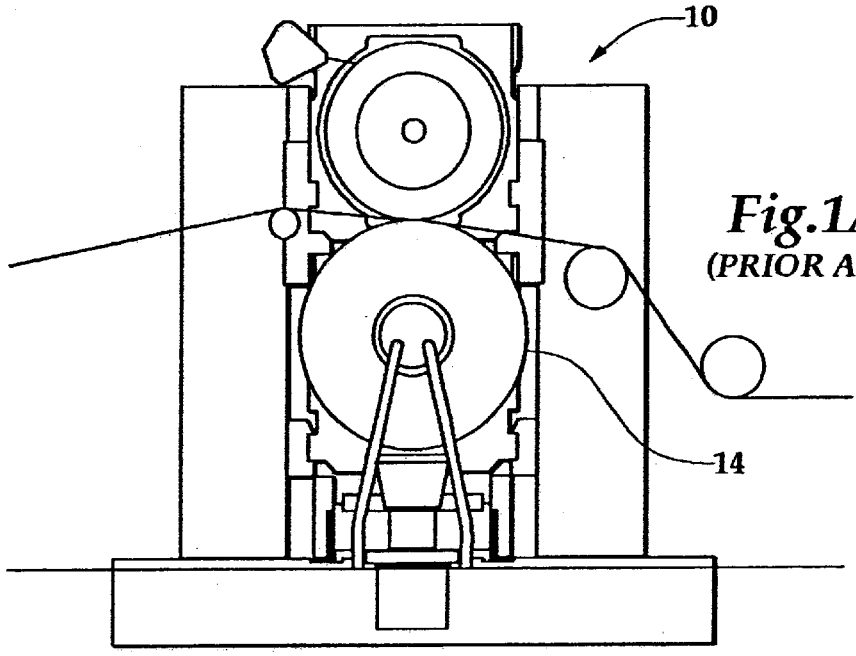
Fig.1A (PRIOR ART)
FIG. 1A is a side elevational view of a prior art long nip calender of the shoe-belt type.
Figure 1B:
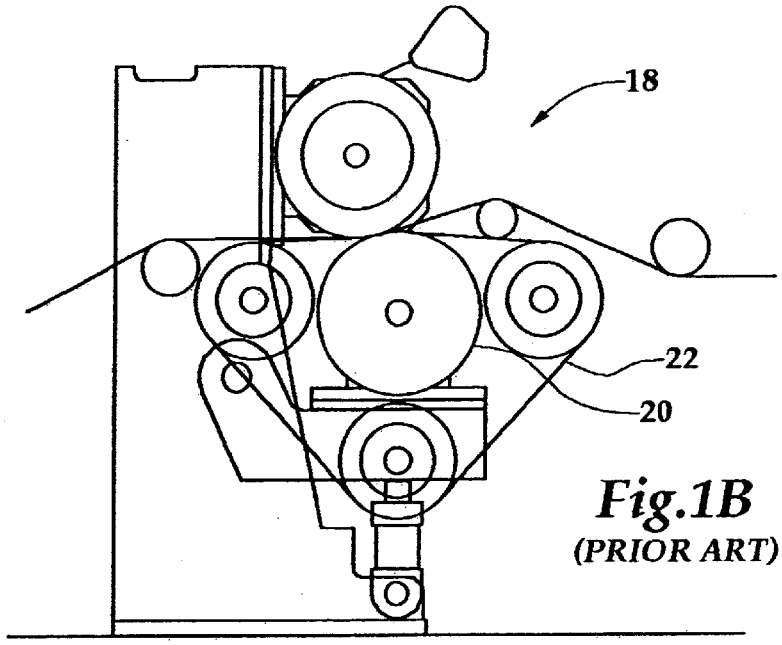
Fig.1B (PRIOR ART)
FIG. 1B is a side elevational view of a prior art long nip calender of the lubricated roll belt type.
Figure 1C:
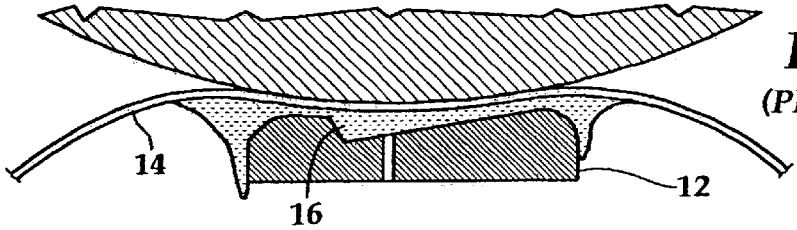
Fig.1C (PRIOR ART)
FIG. 1C is a detail view of the lubricating system for the prior art calender of FIG. 1A.
Figure 2:
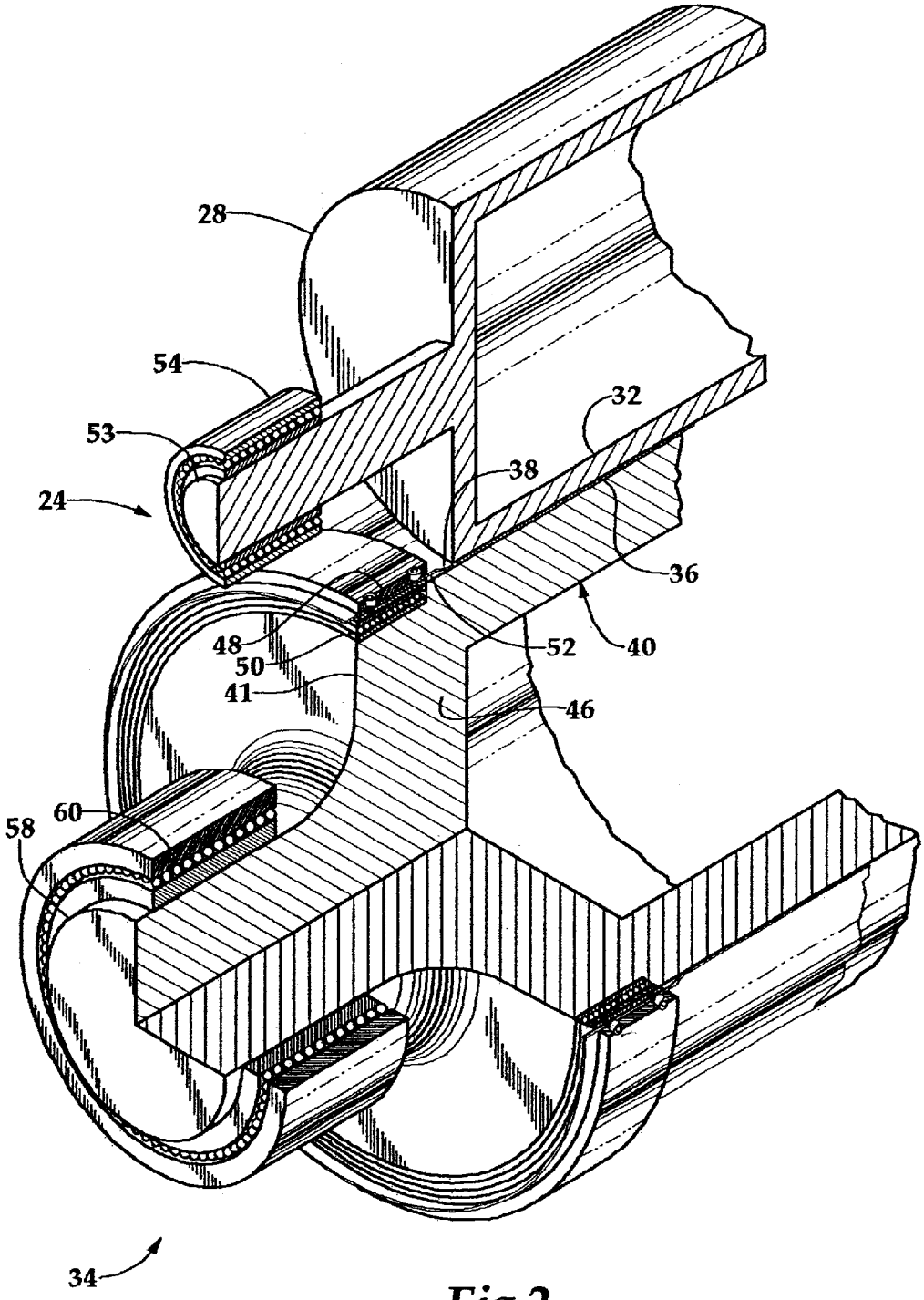
FIG. 2 is an isometric view, partially cut away in section, of the long nip calender of this invention.
Figure 3A:
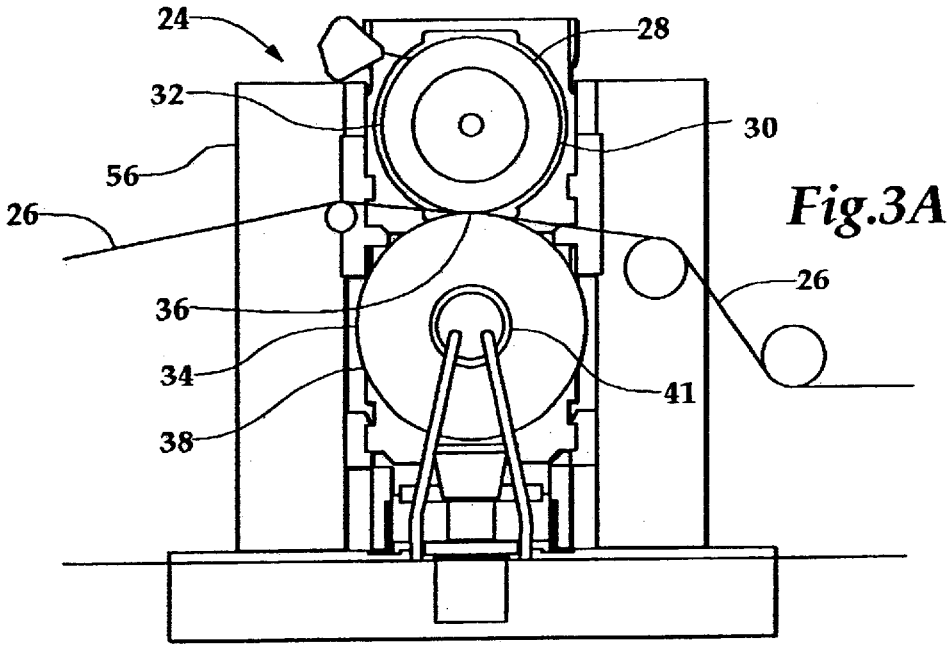
FIG. 3A is a side elevational schematic drawing of the long nip calender of FIG. 2.
Figure 3B:
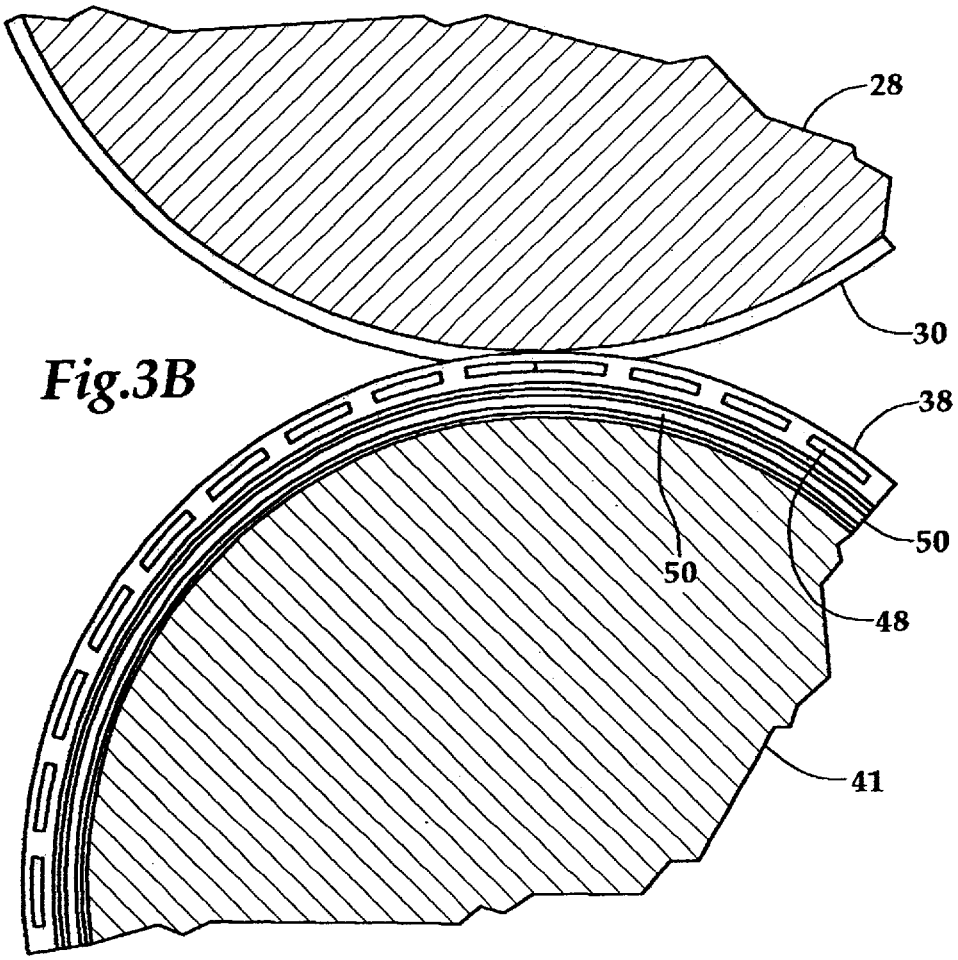
FIG. 3B is in an enlarged fragmentary view of the long nip calender of FIG. 3A.
Figure 4:
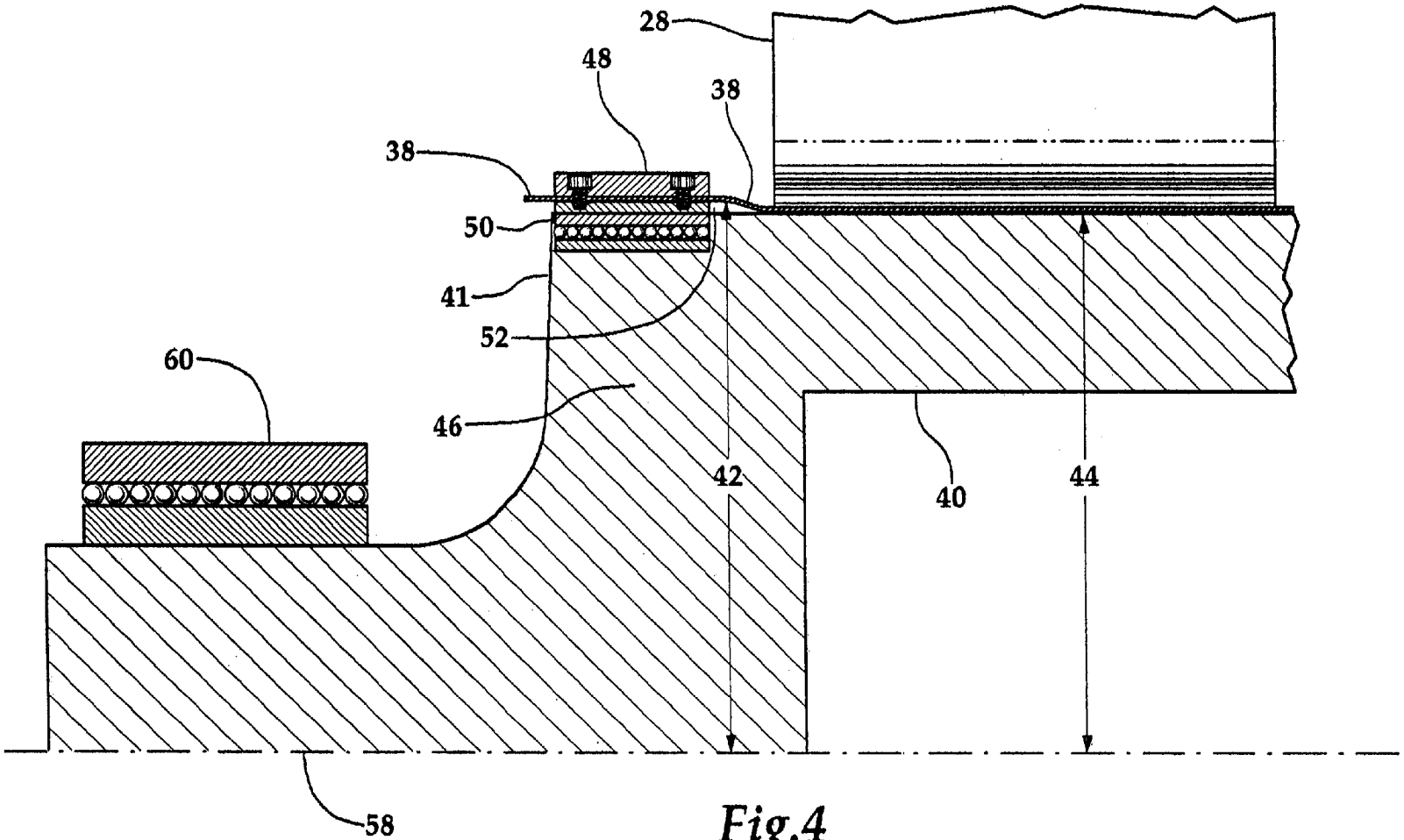
FIG. 4 is a cross-sectional view of the long nip calender of FIG. 2 taken along section line 4—4.

Referring more particularly to FIGS. 1A–4 wherein like numbers refer to similar parts, a new concept for LN-calender 24 is proposed in which the same order of compressive stress can be applied as with the "traditional roll-belt configuration." At the same time it takes care of the difficulties with the traditional roll-belt configuration.

Specifically, the LN-calender 24 provides a calender for calendering a web 26, such as a paper web, coated paper web, or paper board web. The LN-calender 24 has a rotating and heatable first calendering roll 28. The surface 30 of the first roll shell 32 which comes into contact with the web 26 has a hard and smooth calendering surface 30. A rotary soft surface counter roll system 34 cooperates with the heatable calendering roll 28 for defining therebetween a calendering nip 36 for the passage therethrough of the web 26. The soft surface counter roll system 34 comprises a smooth polymer mantle belt 38 on the surface of a rotary second calender shell 40 of the second calender roll 41. The inner diameter 42 of the mantle belt 38 is 5–50 mm larger than the outer diameter 44 of the second roll shell 40.

In one embodiment of the invention, the polymer mantle belt 38 is joined to and positioned with respect to the gable 46 of the roll 41 by means of a clamping ring 48, which is preferably attached to the roller gable 46 by bearings 50.

In a preferred embodiment of the invention the inner diameter of the mantle belt 38 is 10–20 mm larger than the outer diameter 44 of the roll shell 40.

The polymer of the mantle belt 38 in a particularly preferred embodiment is polyurethane.

In a further embodiment of the invention there is an oil film between the polymer mantle belt 38 and the rotary calender shell 40.

The invention replaces the stationery beam and shoe system of the shoe-belt configuration 10 with a rotary steel roll. The belt 38 is joined and positioned onto the roller gables 46 by the same type of clamping ring as used for the shoe-belt configuration 10. The inner diameter of the endless mantle belt 38 is approximately 5–50 mm, preferably 10–20 mm larger than the outer diameter of the roll shell 40 in order to avoid unnecessary shear forces between the steel roll 41 and the belt 38 and, moreover, to facilitate change of the belt 38. In order to allow speed differences between the belt 38 and the steel roll 41, the clamping rings 48 are attached to the steel roll by bearings 50. Due to the bearings 50 the clamping rings 48 can rotate independently of the roll shell 40.

The first calender roll 28 has a roll neck 53 by which the roll 28 is mounted by a roll bearing 54 to a calender frame 56. Similarly, the second calender roll 41 has a roll neck 58 which is mounted by a roll bearing 60 to the frame 56.

The new concept solves most of the difficulties with the traditional roll-belt configuration 18:

The clamping rings 48 take care of the difficulties in controlling the cross machine direction alignment of the polymer belt. This is proven to work for a shoe-belt configuration exceeding a width of seven meters.

The system with the clamping ring 48 on the roller gables 50 provides a closed chamber 52 with the belt 38, thus the pollution problem is solved.

The cord of the base fabric of the belt can be arranged to reward expansion in machine direction, but not in the cross machine direction.

In addition, if it is necessary to allow the belt 38 to expand in the cross machine direction to some extent, a limited proportion of oil can be added to the chamber 52 formed between the roll shell and the belt. An oil film will than provide hydrodynamic lubrication between the roll shell 40 and the belt 38 in the nip 36.

It is understood that the invention is not limited to the particular construction and arrangement of parts herein illustrated and described, but embraces all such modified forms thereof as come within the scope of the following claims.

I claim:

1. A soft nip calender fix calendering a web comprising:

a calender frame;

a first heated calender roll mounted for rotation to the frame, the roll having a first cylindrical shell defining a web contacting surface, the surface being hard and smooth;

a second calender roll, the roll having a second cylindrical shell having a first selected exterior diameter, the second cylindrical roll being mounted for rotation to the calender frame in spaced parallel relation with the first heated calender roll, the second calender roll defining roll gables at opposed ends of the second calender roll; and an endless polymer mantle belt mounted coaxially with a second calender roll, the mantle belt defining an interior diameter, the interior diameter of the mantle belt being 5–50 mm larger than the first selected diameter;

wherein the polymer mantle belt is joined to the gables of the second calender roll by two spaced clamping rings, wherein the clamping rings are mounted to the gables by bearings.

2. The calender of claim 1, wherein the mantle belt interior diameter is 10–20 mm larger than the first selected diameter.

3. The calender of claim 1, wherein the polymer mantle belt is constructed of polyurethane.

4. The calender of claim 1, further comprising an oil film between the polymer mantle belt and the second cylindrical shell.

5. A soft nip calender for calendering a web comprising:

a calender frame;

a first heated calender roll mounted for rotation to the frame, the roll having a first cylindrical shell defining a web contacting surface;

a second calender roll mounted for rotation to the calender frame in spaced parallel relation with the first heated calender roll, the second calender roll having a second cylindrical shell extending between a first bearing and a second bearing, the second calender roll defining roll gables at opposed ends of the second calender roll; and a looped polymer belt mounted coaxially with the second calender roll, the belt being clamped at a first end to the first bearing, and at a second end to the second bearing, wherein the first bearing and second bearing are circumferentially mounted about the second roll on the roll gables such that the web travels over the looped belt at a nip formed between the first roll and the second roll, the belt being rotatable with respect to the second roll.

6. The calender of claim 5, wherein the second calender roll has an exterior diameter, and wherein the belt has an interior diameter which is 5–50 mm larger than the second calender roll exterior diameter.

7. The calender of claim 5, wherein the polymer belt is constructed of polyurethane.

8. The calender of claim 5, further comprising an oil film between the polymer belt and the second calender roll.

* * * * *

UNITED STATES PATENT AND TRADEMARK OFFICE

CERTIFICATE OF CORRECTION

PATENT NO. : 6,598,521 B2
DATED : July 29, 2003
INVENTOR(S) : Magnus Wikström

It is certified that error appears in the above-identified patent and that said Letters Patent is hereby corrected as shown below:

Column 4,
Line 2, the term "fix" should be -- for --.

Signed and Sealed this

Twenty-third Day of September, 2003

JAMES E. ROGAN
*Director of the United States Patent and Trademark Office*